United States Patent [19]

Benedict et al.

[11] 4,102,534

[45] Jul. 25, 1978

[54] PNEUMATIC HAMMER

[75] Inventors: Neil W. Benedict, Evanston, Ill.; Robert J. White, West Bloomfield, Mich.

[73] Assignee: Ajax Tool Works, Inc., Franklin Park, Ill.

[21] Appl. No.: 757,871

[22] Filed: Jan. 10, 1977

[51] Int. Cl.[2] ..... B25D 9/00

[52] U.S. Cl. ..... 173/137; 173/17

[58] Field of Search ..... 173/15, 16, 17, 114, 173/133, 135, 137, 139

[56] References Cited

U.S. PATENT DOCUMENTS

| | | | |
|---|---|---|---|
| 1,591,930 | 7/1926 | Smith | 173/114 |
| 3,446,291 | 5/1969 | Judd et al. | 173/17 |
| 3,625,295 | 12/1971 | Gunning | 173/15 |
| 3,791,149 | 2/1974 | Strecker et al. | 173/123 |
| 4,018,291 | 4/1977 | Anderson | 173/139 |

*Primary Examiner*—Robert A. Hafer

*Attorney, Agent, or Firm*—Fitch, Even, Tabin & Luedeka

[57] ABSTRACT

A hand held impact tool is disclosed which employs an impact piston reciprocated by means of fluid pressure to impact a working tool. Fluid pressure is continually supplied to a pressure chamber forwardly of the impact piston such that a fluid cushion is established between the forward end of the piston and a piston stop surface resulting in substantial noise reduction. The working tool is biased outwardly of the tool housing by fluid pressure such that the working tool must be placed against an external object and moved axially inwardly to effect impact with the piston, whereby accidental ejection or unintentional operating movement of the working tool is prevented.

7 Claims, 2 Drawing Figures

PNEUMATIC HAMMER

Figures 1, 2:
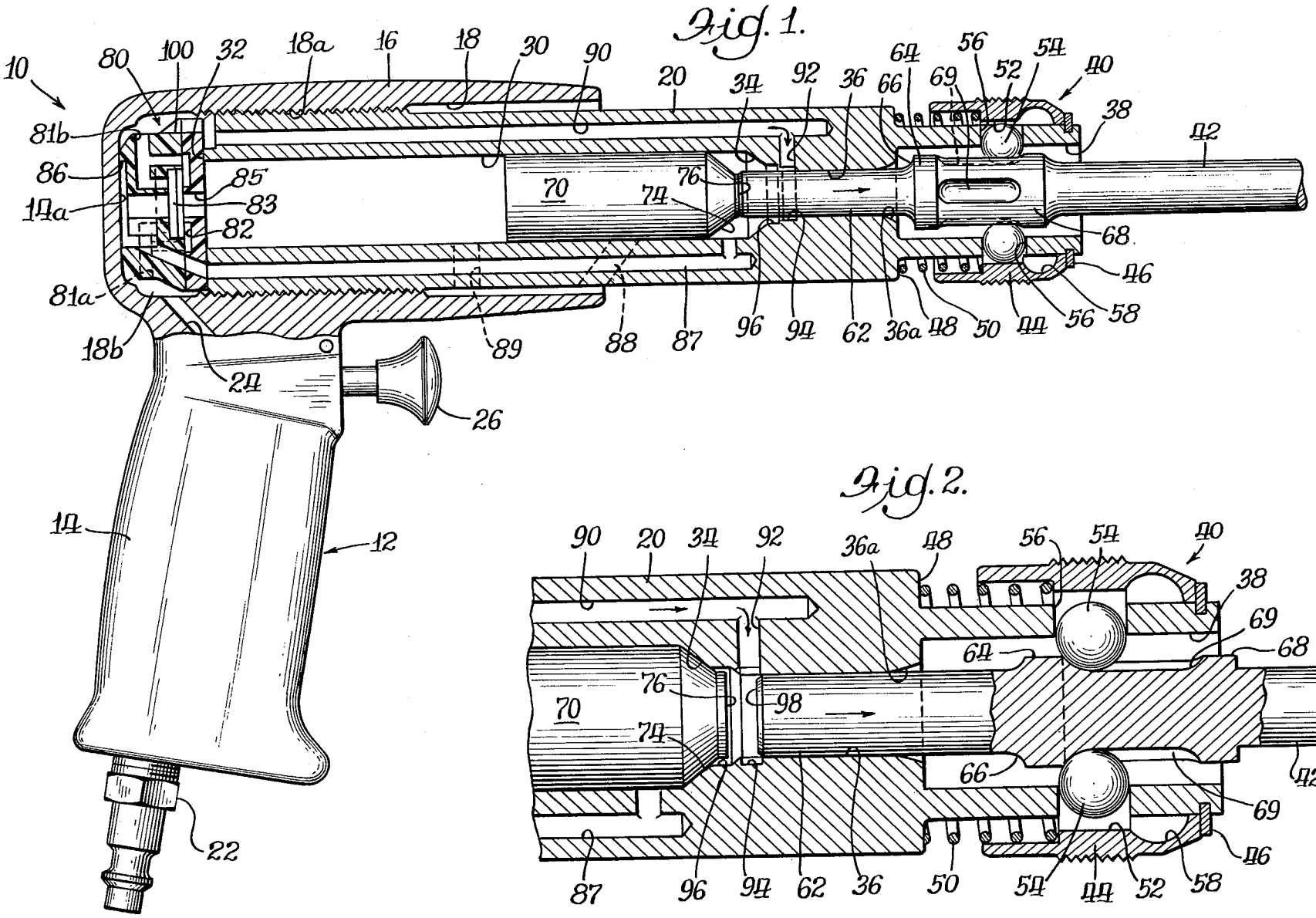

The present invention relates generally to impact tools, and more particularly to a trigger operated hand held impact tool having a novel construction which effects a reduced noise level, increases the operating life of the tool, and increases safety by preventing unintentional ejection of the working tool.

Known impact tools, and particularly those which may be held and manipulated by hand such as power impact chisels and hammers and the like, conventionally employ impact pistons which are reciprocated by means of fluid pressure and are caused to impact a tool which is supported for axial movement relative to the tool support housing. The outer end of the tool, which may be termed the working tool, is adapted to effect the desired chiseling, hammering or other intended purpose of the tool. The impact piston is generally constrained within a piston chamber of bore in a housing for reciprocating movement along an axial aligned with the axis of the tool. Movement of the piston in a forward direction is limited by impact with a stop or "bridge" surface. It has been found that continuous impacting against the stop surface by the impact piston may cause the housing to fracture with substantial shortening of the life of the tool. The impact of the piston against the stop surface also results in a relatively high noise level during operation which may have an adverse affect on the operator.

Recent Federal legislation for the safety of workers requires a reduction in noise levels in work areas for some users of these types of impact hammer tools; or in the absence of reduction in noise levels, this legislation requires expensive periodic testing of the workers' hearing to detect very early any adverse effects on the worker's ear from the noise level being encountered by the worker. Thus, a reduction in noise level may have a significant impact on the commercial utility of and sales of pneumatic impact hammer tools.

Another drawback of known impact tools is that if the working tool is inserted into the support housing while the impact piston is reciprocating, such as occurs with the actuating trigger in an "on" position, the tool may be impacted by the reciprocating piston and accidentally ejected or propelled from the tool support housing whereupon it may strike the operator or another party or damage the tool. This presents a very real safety problem; and with Federal legislation being most concerned with increasing the worker's safety, this may become an important factor in sales of impact hammer tools.

One of the primary objects of the present invention is to provide a hand held fluid pressure operated hammer impact tool which overcomes the disadvantages found in the known prior art impact hammer tools by substantially reducing the noise level during operation while simultaneously prolonging the useful life of the tool.

Another object of the present invention is to provide a hand held fluid pressure operated impact tool wherein the working tool, such as a chisel, must be placed against an external object and moved axially inwardly in order to effect impact of the tool with the impact piston during operation.

A feature of the impact tool in accordance with the present invention lies in the provision of means for continually supplying fluid pressure to the forward end of the impact piston such that the piston is subjected to a fluid pressure cushion as it approaches engagement with a stop or "bridge" surface. This results in a substantially reduced noise level and partial dissipation of the impacting force whereby to prolong the life of the impact tool.

Another feature of the invention lies in the provision of an impact tool having releasable tool mounting means cooperative with a working tool such that the tool is axially movable between a first rearward position wherein its inner end may be impacted by the reciprocation impact piston and a second outer position wherein its inner end may not be impacted by the impact piston, it being necessary that the operator place the outer end of the tool against an external object, such as a workpiece, and move the tool to its inner position for impact by the impact piston, with the result that unintentional or accidental ejection of the working tool during insertion into the tool mounting means is prevented.

Further objects and advantages of the present invention, together with the organization and manner of operation thereof, will become apparent from the following detailed description of the invention when taken in conjunction with the accompanying drawing wherein like reference numerals designate like elements in the several views, and wherein:

FIG. 1 illustrates a hand held fluid pressure operated impact tool, partially in longitudinal section, employing the present invention; and FIG. 2 is an enlarged partial longitudinal sectional view of the impact tool of FIG. 1, the tool being shown in its outermost position with the impact piston engaging the forward stop surface.

Referring now to the drawings, and in particular to FIG. 1, a hand held fluid pressure operated impact tool is indicated generally at 10. The impact tool 10 might alternatively be termed a percussion apparatus and may be used for hammering, chiseling or the like, as will become more apparent hereinbelow. The illustrated tool is commonly referred to as a hand held "pneumatic hammer" in the trade. The impact tool 10 includes housing means, indicated generally at 12, having a handle or hand gripping portion 14 and an upper tubular barrel receiving portion 16 formed integral with the hand gripping portion and defining a generally cylindrical chamber 18 therein. The housing means 12 also includes an elongated cylindrical tubular housing or barrel 20 which is received within the chamber 18 and threadedly secured to a threaded bore **18*a* within chamber 18. The barrel 20 comprises a working tool support housing which extends axially outwardly from the chamber 18**, as shown.

The hand gripping portion 14 has a pressure hose fitting 22 secured thereto for connection through a fluid pressure hose to a source of fluid pressure (not shown) such as a conventional source of pneumatic pressure. First fluid pressure passage means in the form of a fluid pressure passage 24 is provided in the handle 14 and communicates with the pressure hose fitting 22 and a chamber **18*b* rearwardly of the inner end of the barrel 20. A finger operated trigger or valve actuator 26 is mounted on the hand gripping portion 14 and is operatively associated with a suitable control valve (not shown) within the handle to control fluid pressure flow through the passage 24 to the chamber 18*b***.

The tubular barrel 20 has a cylindrical axial bore 30 formed therein which serves as a piston chamber. The bore 30 intersects a rearward end surface 32 of the barrel and terminates at its forward end in a frustoconical stop surface 34 which may alternatively be termed a "bridge" surface. A reduced diameter axial bore 36 intersects the bore 30 and terminates at its forward end in an enlarged diameter cylindrical bore 38.

The barrel 20 supports a quick release tool mounting means, indicated generally at 40, at its forward end to releasably retain a working tool, a portion of which is indicated at 42. The quick release tool mounting means 40 includes an annular retainer sleeve 44 which is concentric with bore 38 and is axially movable relative to the barrel 20 between a forward position disposed against a retainer ring 46, and a rearward position abutting a stop or shoulder surface 48 on the barrel 20. A coil compression spring 50 acts between the shoulder surface 48 and the retainer sleeve 44 to bias the sleeve against the retainer ring 46. The retainer sleeve 44 has a reduced diameter inner annular surface 52 which, with the retainer sleeve 44 in the position shown in FIG. 1, serves to limit radial outward movement of a plurality of retaining balls 54 each of which is disposed within a frustoconical shaped opening 56 in the wall of the barrel 20. Four balls 54 are equidistantly circumferentially spaced about the axis of bore 38 and are normally disposed in positions wherein portions of the balls project within the cylindrical bore 38. The retainer sleeve 44 has an inner enlarged diameter recess surface 56 which facilitates radial outward movement of the balls 54 when the retainer sleeve is moved longitudinally rearwardly from the retainer ring 46 to position the recess 58 over the balls 54 as is known.

To facilitate insertion of the tool 42 within the bores 38 and 36 of barrel 20 for cooperation and retention by the mounting means 40, the tool 42 has an axial shank portion 62 which has an outer diameter sufficient to allow the shank to be readily received within the bore 36. The peripheral surface of shank portion 62 blends with an annular flange 64 through a curved surface 66, the bore 36 having a similar curvature at **36*a* for abutment with the tool surface 66 to limit rearward movement of the tool 42 into the barrel 20. When inserting the tool 42 into the bore 38, the retainer sleeve 44 is moved rearwardly to a position allowing radial outward movement of the balls 54 so that the flange 64 may pass rearwardly of the retaining balls 54. The tool 42 has a reduced diameter generally cylindrical surface 68 forwardly of the flange 64. Four circumferentially spaced elongated slots or grooves 69 are formed in surface 68 so that once the flange 64 has passed rearwardly of the balls 54 and the retainer sleeve 44 has been returned to its forward position, each of the balls may be received within a corresponding groove 69. In this manner, the tool 42 is axially movable relative to the barrel 20 between a rearward position, wherein the surface 66 engages the surface 36*a* of bore 36, and a forward position wherein the flange 64 engages the balls 54. The balls 54 retain tool 42 within the barrel 20 until the retainer sleeve 44** is again moved to its rearward position allowing release and withdrawal of the tool.

The tool 42 has an outer end portion (not shown) which may be adapted for cutting, hammering, riveting or the like in a known manner during reciprocating movement of the tool.

A cylindrical impact piston 70 is axially slidable in the piston chamber 30 of barrel 20. The piston 70 has a rearward end surface 72 and a forward frustoconical surface 74 terminating at its forward edge in an end surface 76 disposed normal to the axis of piston 10. Axial movement of the piston 70 is limited in its forward direction by engagement of the frustoconical surface 74 with the stop or bridge surface 34 within the bore 30.

Valve means, indicated generally at 80, is disposed between the rear end surface 32 of the barrel 20 and an interior surface **14*a* within the chamber 18*b*. The valve means 80 is of known design, being commercially available from Chicago Pneumatic Tool Co., Broadview, Ill., and is operative to effect reciprocating movement of the impact piston 70 by alternately subjecting the opposite ends of the piston to fluid pressure. To this end, the valve means 80 includes a pair of fluid flow passages 81*a* and 81*b* which provide fluid pressure communication between the chamber 18*b* and a recess 82. A valve disc 83 is disposed within a valve chamber 84 and is movable by fluid pressure differential to effect fluid pressure communication alternatively with an axial fluid pressure passage 85 and a valve chamber 86. The axial passage 85 communicates directly with the piston chamber 30 rearwardly of piston 70, while a fluid pressure passage 87 provides fluid pressure communication between the chamber 86 and the forward end of the piston chamber 30. The fluid pressure passages 85 and 87 constitute second fluid pressure passage means which communicate with the first fluid pressure passage means 24 and are adapted to apply fluid pressure against opposite ends of the impact piston 70. The valve means 80 is thus cooperative with the first and second fluid pressure passage means to alternately subject the opposite ends of piston 70 to fluid pressure so as to effect reciprocating movement of the piston when the first fluid pressure passage means 24 is connected to a source of fluid pressure through actuation of the valve actuator 26. A pair of exhaust passages 88 and 89 communicate with the piston chamber 30 to connect the bore 30 to atmosphere depending upon the position of the impact piston 70** during reciprocation, as is known.

The hand held impact tool 10 thus far described is of known design. In apparatus of this type, a working tool, such as 42, is inserted into the barrel 20 and is continuously impacted by the impact piston 70 during the forward stroke of the piston so as to continually cause the outer end of tool 42 to impact against a workpiece or other object as in a chiseling or hammering operation. It has been found that when the impact piston 70 repeatedly impacts the internal stop surface 34, the barrel may fatigue and fracture in the area of the internal stop surface. Additionally, continued impacting of the impact piston against the stop surface 34 creates a significant noise level which, over an extended period of time, may be detrimental to the operator. A still further problem experienced with the known hand held impact tools is that the working tool, such as 42, may be subjected to an impact force from the reciprocating impact piston during connection of the working tool to the barrel preparatory to operation. In the latter event, the tool may be thrust forwardly and ejected from the barrel whereupon the ejected tool may strike the operator or damage the working tool.

In accordance with the present invention, third fluid pressure passage means in the form of an auxiliary fluid pressure passage 90 is provided in the barrel 20 of the housing means 12. The fluid pressure passage 90 terminates at its forward end in a transverse fluid pressure passage 92, as best seen in FIG. 2. The transverse passage 92 intersects an annular recess 94 formed in the bore 36 and also communicates with the forward end of an enlarged diameter recess area 96 contiguous to the stop surface 34. The stop surface 34 and the annular recess surfaces 94 and 96 are spaced longitudinally rearwardly from the retaining balls 54 a predetermined distance in relation to the length of the shank portion 62 of tool 42 such that when the tool 42 is in its forwardmost position with the flange 64 abutting the balls 54, a rearward end surface 98 on the tool shank 62 will be disposed adjacent the annular recess surface 94 and spaced forwardly from the end surface 76 on the impact piston 70 when abutting the stop surface 34, as illustrated in FIG. 2.

The fluid pressure passage 90 intersects the rearward end surface 32 of the barrel 20 and communicates with the fluid pressure passage 24 through a passage 100 and through the chamber **18*b*, the passage 100 being formed in the valve means 80. In this manner, the fluid pressure passage 90 is continually subjected to fluid pressure when the actuator trigger 26 is depressed. Stated alternatively, the fluid pressure passage 90 is continually subjected to fluid pressure during reciprocating movement of the impact 70. With the auxiliary fluid pressure passage 92 continually subjected to fluid pressure during operation of the impact tool 10, the end of the piston chamber 30 adjacent the stop surface 34 and recess surfaces 94 and 96 will be continually subjected to fluid pressure. In this manner a fluid pressure chamber is established forwardly of the impact piston 70. The fluid pressure within this fluid pressure chamber is sufficient to bias the tool 42 to its outermost position as shown in FIG. 2 so that reciprocating movement of the impact piston 70 is ineffective to engage or impact the end 98 of the tool. With the working tool 42 biased to its outermost position from the barrel 20, it is necessary that the operator engage the outer end of the tool with an external object or workpiece in a manner to force the tool axially rearwardly to a position wherein the end surface 98 will be engaged by the impact piston 70** in order to effect impacting of the working tool.

In addition to the aforedescribed safety feature, the fluid pressure chamber established forwardly of piston 70 by the auxiliary fluid pressure passage 90 provides a fluid pressure cushion for the frustoconical surface 74 of the impact piston as it approaches the stop surface 34 whereby to effect a cushioned impact of the piston surface 74 against the stop surface 34. The cushioned impact serves to reduce the impact force applied against the stop surface 34 by the impact piston 70 with the result that the possibility of fracture of the housing 20 in the area of the stop surface 34 is substantially reduced.

Another feature of the invention lies in the fact that the fluid pressure chamber established by the auxiliary fluid pressure passage 90 significantly reduces the noise level resulting from impact of the impact piston 70 with the stop surface 34 in metal-to-metal contact. This feature of the invention is of particular importance in facilitating compliance with industrial goals for reduced noise levels in production areas. Moreover, the air from the air passage 90 will flow through the tool retainer to blow out dirt, chips or other foreign matter which may try to enter into the tool retainer and be a source of fouling of the retainer. Furthermore, the cushioning of the blow of the piston may result in cushioning of the impact between the retainer balls 54 and the rearward ends of the slots 69 and this reduces the amount of wear of the slots and a prolongation of the life of the working tool. The lessening of the impact may also prolong the life of the tool retainer. While the illustrated working tool is shown with slots for the retainer balls, these slots may be dispensed with and only a radially extending large diameter collar may be formed on the tool in a known and conventional manner, to cooperate with the retainer balls. Also, while the preferred retainer has a ball holding sleeve portion integral with the barrel shaft 20, this sleeve portion may be formed separately to form a removable tool retainer which may be detachably connected to the tool barrel in a known and conventional manner. The integral sleeve portion is preferred as it reduces the exterior diameter of the retainer and the weight of the retainer. The decrease in weight on the outer end of the hammer barrel makes the hammer easier to use.

While a preferred embodiment of the impact tool 10 has been illustrated and described, it will be understood to those skilled in the art that changes and modifications may be made therein without departing from the invention in its broader aspects. Various features of the invention are defined in the following claims.

What is claimed is:

1. A hand holdable fluid pressure operated impact tool for use with a working tool, comprising, in combination, housing means defining a handle portion and having first fluid passage means connectable to a source of fluid pressure, said housing means including a barrel portion defining a piston chamber in communication with said first fluid passage means, an impact piston disposed within said piston chamber for axial reciprocating movement therein, said housing means having second fluid pressure passage means communicating with said first fluid passage means and adapted to apply fluid pressure against opposite ends of said impact piston, valve means supported by said housing means and cooperative with said first and second fluid pressure passage means to alternately subject the opposite ends of said piston to fluid pressure so as to effect reciprocating movement of said piston when said first fluid passage means is connected to a source of fluid pressure, manually operable means cooperable with said first fluid passage means to selectively control fluid pressure to said first fluid pressure passage means causing said impact piston to reciprocate irrespective of the position of said working tool, working tool mounting means cooperative with said housing means to mount a working tool on said housing means such that the axis of said working tool is aligned with the direction of movement of said impact piston, said working tool mounting means facilitating longitudinal movement of said working tool relative to said housing means between a first position wherein said working tool may be engaged by said impact piston and a second position where said working tool cannot be engaged by said impact piston so that said working tool must be moved to its said first position in order to effect impact with said piston, said housing means defining an annular stop surface at the forward end of said piston chamber to limit movement of said impact piston in the direction toward said working tool, said housing means further defining a fluid pressure chamber contiguous to said stop surface and in open communication therewith, third fluid pressure passage means formed in said housing means and having upon operation of said manually operable means, continual fluid communication with said first fluid pressure passage means and said fluid pressure chamber so as to continually introduce fluid pressure into said fluid pressure chamber and establish a fluid pressure cushion between said impact piston and said stop surface so that impact forces on said stop surface effected by said impact piston are substantially dissipated prior to direct impact thereagainst, fluid pressure from said third fluid pressure passage means also being adapted to subject said working tool to fluid pressure in a manner to bias said working tool toward its said second position during operation of said impact tool.

2. An impact tool as defined in claim 1 wherein said mounting means includes tool retaining means cooperable with a working tool to facilitate mounting of said working tool on said housing means with said working tool in its said second position so that said working tool is not engaged by said impact piston during mounting of said working tool.

3. An impact tool as defined in claim 2 wherein said tool retaining means includes a plurality of retaining balls adapted for cooperation with a working tool having an elongated recess cooperative with each of said retaining balls to retain said working tool on said housing means, said elongated recesses allowing axial movement of said working tool relative to said housing means between said first and second positions and facilitating mounting of said working tool on said housing means while said impact piston is reciprocating without said working tool being engaged by said impact piston.

4. In a hand holdable fluid pressure operated impact device for use with a working tool, said device including housing means defining a handle portion and having first fluid pressure passage means connectable to a source of fluid pressure and having trigger actuator means to admit air to said first fluid passage means, said housing means including a barrel portion defining a piston chamber in communication with said first fluid pressure passage means, an impact piston disposed within said piston chamber for axial reciprocating movement therein, said housing means having second fluid pressure passage means communicating with said first fluid pressure passage means and adapted to apply fluid pressure against opposite ends of said impact piston, valve means supported by said housing means and cooperable with said first and second fluid pressure passage means to alternately subject the opposite ends of said impact piston to fluid pressure so as to effect reciprocating movement of said piston when said first fluid pressure passage means is connected to a source of fluid pressure, working tool mounting means cooperative with said housing means to mount a working tool on said housing means such that the axis of said working tool is aligned with the direction of movement of said impact piston, said housing means defining a stop surface at one end of said piston chamber to limit movement of said piston in the direction toward said working tool; the improvement wherein said stop surface comprises an annular stop surface at the forward end of said piston chamber, and wherein said housing means defines a fluid pressure chamber contiguous to said stop surface and in open communication therewith, said housing means further including third fluid pressure passage means communicating with said first fluid pressure passage means and said fluid pressure chamber and adapted with operation of said trigger actuator means to continually introduce fluid pressure into said fluid pressure chamber during operation of said device so that a fluid pressure cushion is continually established between said impact piston and said stop surface whereby impact forces on said stop surface are substantially dissipated prior to direct impact by said piston against said stop surface.

5. The improvement of claim 4 wherein said device includes manually operable control means cooperable with said first fluid pressure passage means to control reciprocating movement of said impact piston.

6. The improvement of Claim 4 wherein said working tool mounting means is cooperative with a working tool to facilitate axial movement of the working tool between inner and outer positions relative to said housing means, said barrel portion including a working tool receiving passage axially aligned with and intersecting said piston chamber, said third fluid pressure passage means intersecting said tool receiving passage generally adjacent its intersection with said piston chamber, said fluid pressure cushion also acting between said impact piston and said working tool to bias said working tool toward its said outer position relative to said housing means as said impact piston moves toward said working tool.

7. The improvement as defined in claim 6 wherein said working tool mounting means includes releasable retainer means cooperable with said working tool to retain said tool within said tool mounting means, said releasable retainer means and said tool being cooperative to facilitate mounting of said working tool on said housing means while said impact piston is reciprocating without said tool being engaged by said reciprocating impact piston.

* * * * *